US008011525B2

(12) United States Patent
Robinson

(10) Patent No.: US 8,011,525 B2
(45) Date of Patent: Sep. 6, 2011

(54) CHILD-RESISTANT CONTAINER HAVING A DEFLECTABLE RELEASE

(75) Inventor: Philip J Robinson, Toledo, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 344 days.

(21) Appl. No.: 12/276,832

(22) Filed: Nov. 24, 2008

(65) Prior Publication Data

US 2010/0126955 A1 May 27, 2010

(51) Int. Cl.
*B65D 43/04* (2006.01)
*B65D 50/08* (2006.01)

(52) U.S. Cl. ..... 220/281; 215/209; 215/901

(58) Field of Classification Search ..... 215/209, 215/216, 217, 221, 901; 220/281
See application file for complete search history.

(56) References Cited

U.S. PATENT DOCUMENTS

| | | | | |
|---|---|---|---|---|
| 4,036,385 | A | 7/1977 | Morris | |
| 4,103,797 | A | 8/1978 | Morris | |
| 5,379,910 | A | 1/1995 | Montgomery | |
| 5,711,442 | A | 1/1998 | Kusz | |
| 5,899,348 | A | 5/1999 | Konefal et al. | |
| 6,039,195 | A | 3/2000 | Konefal et al. | |
| 6,327,770 | B1 | 12/2001 | Konefal et al. | |
| 7,628,283 | B2 * | 12/2009 | Shingle | 215/209 |
| 2009/0301985 | A1 * | 12/2009 | Priebe et al. | 215/211 |

* cited by examiner

*Primary Examiner* — Harry Grosso
(74) *Attorney, Agent, or Firm* — Reising Ethington PC

(57) ABSTRACT

A plastic container for a child-resistant package, including a sidewall with an outer surface, a deflectable release cantilevered from the outer surface and deflectable toward the outer surface, and deflection limiting elements carried by the deflectable release to limit deflection of the release. The deflection limiting elements include laterally spaced lugs transversely extending toward the sidewall outer surface from the deflectable release and having portions normally spaced from the sidewall outer surface, such that deflection of the release brings the portions of the lugs into abutment with the sidewall outer surface.

15 Claims, 3 Drawing Sheets

CHILD-RESISTANT CONTAINER HAVING A DEFLECTABLE RELEASE

The present disclosure is directed to child-resistant closure and container packages, such as medicinal packages for example, and to containers for such packages.

BACKGROUND AND SUMMARY OF THE DISCLOSURE

U.S. Pat. Nos. 5,899,348, 6,039,195, and 6,327,770 disclose closure and container packages that are particularly well suited for prescription applications. In the packages, the container includes a sidewall with threads formed on an external surface of a neck finish and a deflectable release located just below the threads and cantilevered from the neck finish. The closure includes an internally threaded peripheral skirt having a locking lug at an inside edge of the skirt. This locking lug on the skirt cooperates with a locking lug on the deflectable release of the container for securing the closure to the container in a child-resistant mode of operation. To release the closure, the release is deflected downwardly toward the container sidewall to move the locking lug on the release out of engagement with the locking lug on the closure skirt. Although the packages disclosed in the noted patents have enjoyed substantial commercial acceptance and success, improvements remain desirable.

A general object of the present disclosure, in accordance with one aspect of the disclosure, is to provide a package of this general type in which fang-like deflection limiting lugs of the container are eliminated.

The present disclosure embodies a number of aspects that can be implemented separately from or in combination with each other.

A container for a child-resistant package in accordance with one aspect of the disclosure includes a plastic container body having an outer wall surface, at least one external thread segment, and a deflectable release element cantilevered from the outer wall surface beneath the thread segment and deflectable in an arc downwardly and inwardly toward the outer wall surface. The container body also includes stop means between the deflectable release element and the outer wall surface to limit deflection of the release element. The stop means include laterally spaced lugs on an underside of the deflectable release element, the lugs extending toward the outer wall surface and having inside edges normally spaced from the outer wall surface such that deflection of the release element brings the inside edges of the lugs into abutment with associated laterally spaced points of contact on the outer wall surface. The stop means also include a first pair of stops on the outer wall surface respectively positioned laterally outwardly of the points of contact such that further deflection of the release element after contact of the inside edges with the outer wall surface spreads the lugs laterally outwardly until the inside edges abut the first pair of stops.

In accordance with another aspect of the disclosure, there is provided a plastic container for a child-resistant package. The container includes a sidewall with an outer surface, at least one external thread, a deflectable release cantilevered from the outer surface beneath the thread and deflectable axially downwardly and radially inwardly toward the outer surface, and deflection limiting elements carried by the deflectable release and the sidewall outer surface to limit deflection of the release. The deflection limiting elements include laterally spaced lugs transversely extending toward the sidewall outer surface from the deflectable release and having portions normally spaced from the sidewall outer surface, such that deflection of the release brings the portions of the lugs into abutment with the sidewall outer surface. The deflection limiting elements also include stop edges on the sidewall outer surface respectively positioned laterally outwardly of the laterally spaced lugs, such that further deflection of the release after contact of the lug portions with the sidewall outer surface spreads the lugs laterally outwardly until the inside edges abut the stop edges.

In accordance with a further aspect of the disclosure, there is provided a plastic container for a child-resistant package. The container includes a sidewall with an outer surface, a deflectable release cantilevered from the outer surface and deflectable toward the outer surface, and deflection limiting elements carried by the deflectable release to limit deflection of the release. The deflection limiting elements include laterally spaced lugs transversely extending toward the sidewall outer surface from the deflectable release and having portions normally spaced from the sidewall outer surface, such that deflection of the release brings the portions of the lugs into abutment with the sidewall outer surface.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
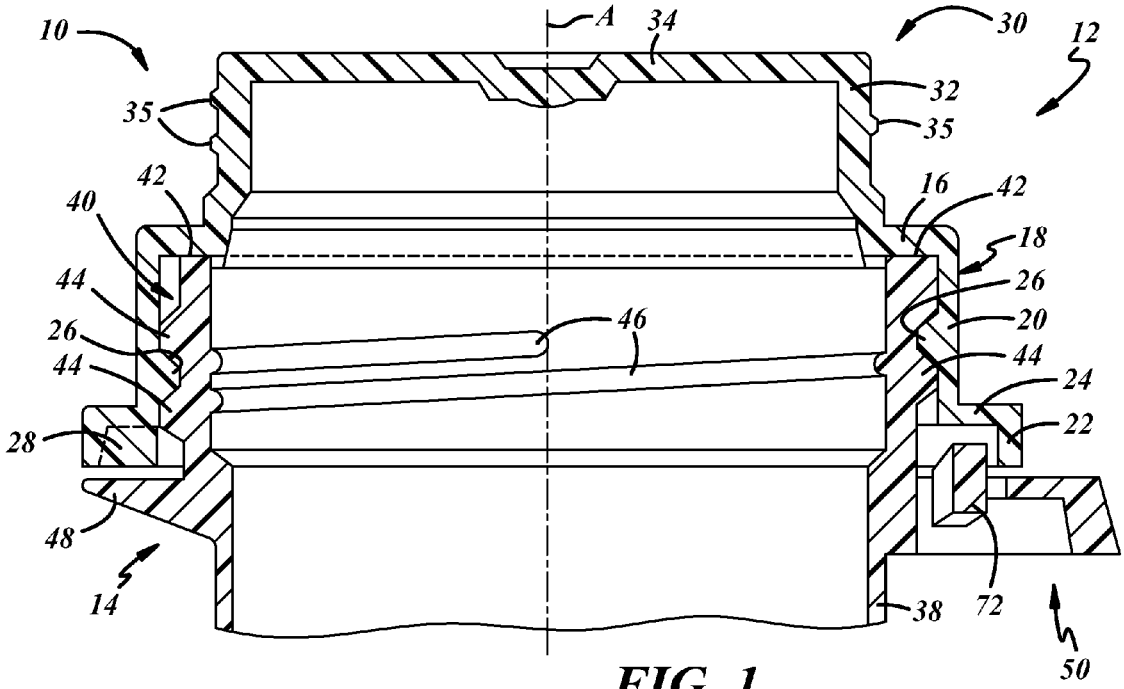
FIG. 1 is a fragmented cross-sectional view a closure and container package in accordance with an exemplary embodiment of the present disclosure.

FIG. 1 illustrates a child-resistant (CR) closure and container package 10 that includes a closure 12, which is coupled in any suitable manner to a container 14 of the package 10. The package 10 extends generally longitudinally along an axis A, and is used to contain and close any desired product, for example, pills, tablets, or other pelletized items. As one example, the closure 12 and the container 14 are injection molded from polypropylene, but may be manufactured in any suitable manner and composed of any suitable material(s).

Still referring to FIG. 1, the closure 12 includes a base wall 16 that extends generally transversely with respect to the axis A, and a skirt 18 that extends in a generally axial direction from the base wall 16. The skirt 18 includes a first portion 20, and a second portion 22 that is coupled to the first portion 20 via a first shoulder 24. The first portion 20 includes first container coupling elements 26 for coupling the closure 12 to the container 14 in a CR mode of operation as illustrated, and that includes one or more internal threads. As used herein, the term thread includes whole, partial, multiple, and/or an interrupted thread and/or thread segment. The second portion 22 is a rim that includes one or more locking lugs 28 coupled between the rim and the shoulder 24 for cooperating with the container 14 in a CR mode of operation.

The closure 12 includes a projection 30, preferably a hollow dome, that includes a generally axially extending wall 32 and a generally transversely extending wall 34. The wall 32 includes second container coupling elements 35 for coupling the closure 12 to the container 14 in a non-CR mode of operation (not shown). The coupling elements 35 include one or more external threads.

Figure 2:
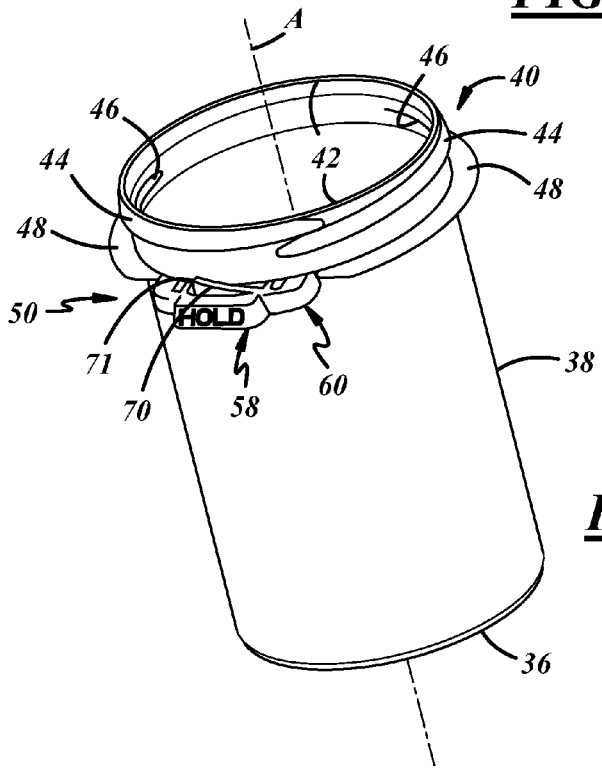
FIG. 2 is a perspective view of a container of the package of FIG. 1.

Referring to FIGS. 1 and 2, the container 14 includes a base 36 (FIG. 2) that extends generally transversely with respect to the axis A, and a sidewall 38 that extends in a generally axial direction from the base 36. (As used herein, directional words such as top, bottom, upper, lower, radial, circumferential, lateral, longitudinal, transverse, vertical, horizontal, and the like are employed by way of description and not limitation.) At an end opposite the base 36, the container 14 includes a neck finish 40 that defines an open mouth 42, one or more external CR mode closure engagement elements 44, and/or one or more internal non-CR mode closure engagement elements 46. The open mouth 42 is adapted to axially seal against the shoulder 24 of the closure 12 (FIG. 1) in the CR and/or non-CR modes of operation. Between the open mouth 42 and the base 36, the container 14 includes a radial flange 48 that extends at least partially circumferentially around the container 14, and a deflectable release 50 that is cantilevered from the sidewall 38 and disposed at an interruption in the flange 48.

Figure 3:
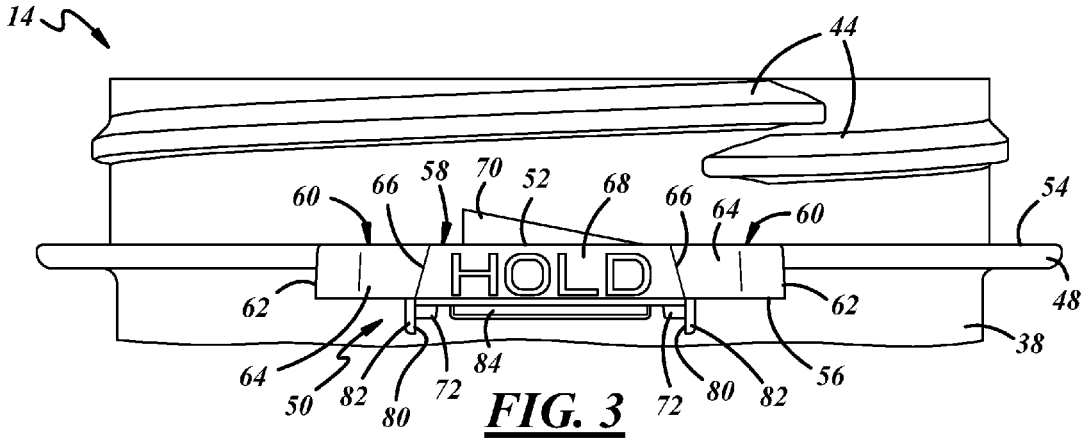
FIG. 3 is an enlarged fragmented elevational view of a portion of the container shown in FIG. 2.
Figure 4:
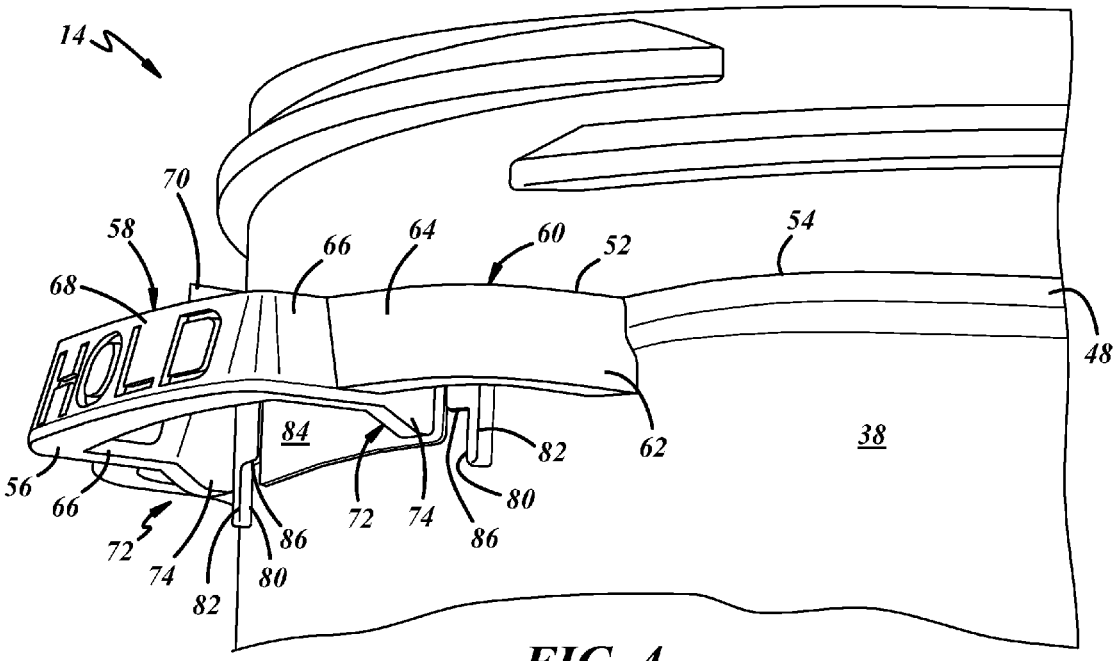
FIG. 4 is an enlarged fragmented perspective view of a portion of the container shown in FIG. 2.

Referring to FIGS. 3 and 4, the release 50 is disposed below the engagement element(s) 44 and includes an upperside 52 that is coextensive with a top 54 of the flange 48, and an underside 56 that is disposed below the flange 48. The release 50 includes a finger tab 58 that is coupled to the sidewall 38 by laterally spaced arms 60 that is flexible and resilient and extends generally transversely such that the finger tab 58 is transversely spaced from the sidewall 38. As used herein, the term transverse means disposed at some angle with respect to the axis A and along any direction intersecting the container 14, and includes but is not limited to the radial direction. Also, as used herein, the term lateral means disposed at some angle with respect to the axis A and along any direction not intersecting the container 14, and includes but is not limited to a tangential or circumferential direction.

The arms 60 include generally transversely extending portions 62 that are coupled to the sidewall 38 and generally laterally extending portions 64 coupled between the portions 62 and the finger tab 58. Similarly, the finger tab 58 includes generally transversely extending portions 66 coupled to the arm portions 64 and a generally laterally extending portion 68 therebetween. The finger tab 58 and the arms 60 define a strap transversely spaced from the sidewall 38, wherein the strap is deflectable in an arc.

Referring again to FIGS. 1 and 2, the release 50 also includes a CR lug 70 that is cantilevered from the release 50, so that the lug 70 flexes together with the finger tab 58 and arms 60 such that there is little to no relative motion therebetween, or so that the lug 70 flexes separately from the finger tab 58 and arms 60 such that there is at least some relative motion therebetween. The lug 70 extends laterally, and axially upwardly, from a portion of the release 50 and (as shown in FIG. 2) the lug 70 extends from the release 50 at a location between the finger tab 58 and one of the arms 60. The CR lug 70 is axially deflectable when the lock lug 28 of the closure 12 traverses the lug 70 upon application of the closure 12 to the container 14, and the lug 70 includes a lateral or circumferential stop surface to cooperate with the lock lug 28 of the closure 12.

Figure 5:
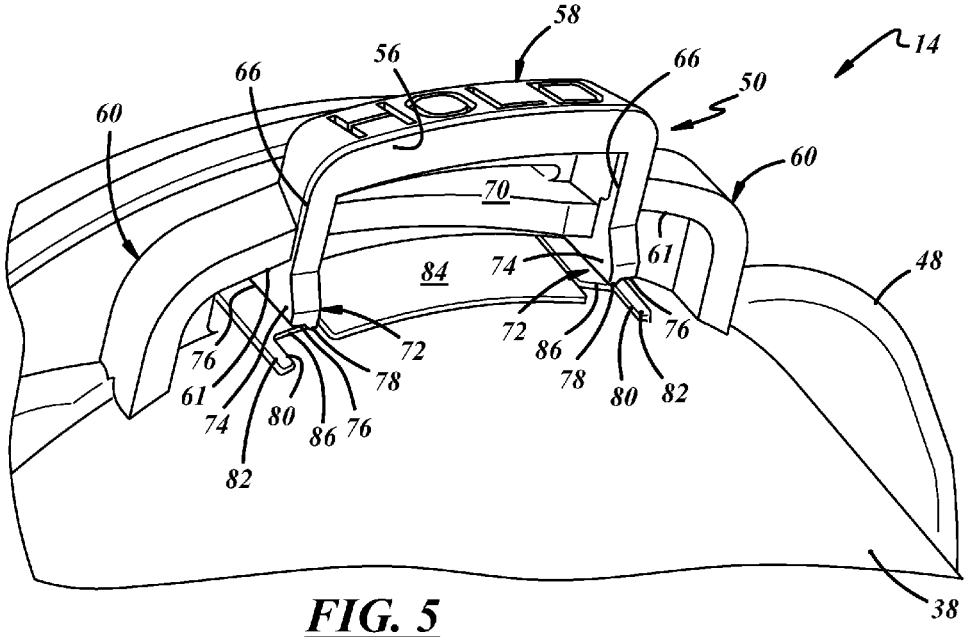
FIG. 5 is another enlarged fragmented perspective view of a portion of the container shown in FIG. 2.
Figure 6:
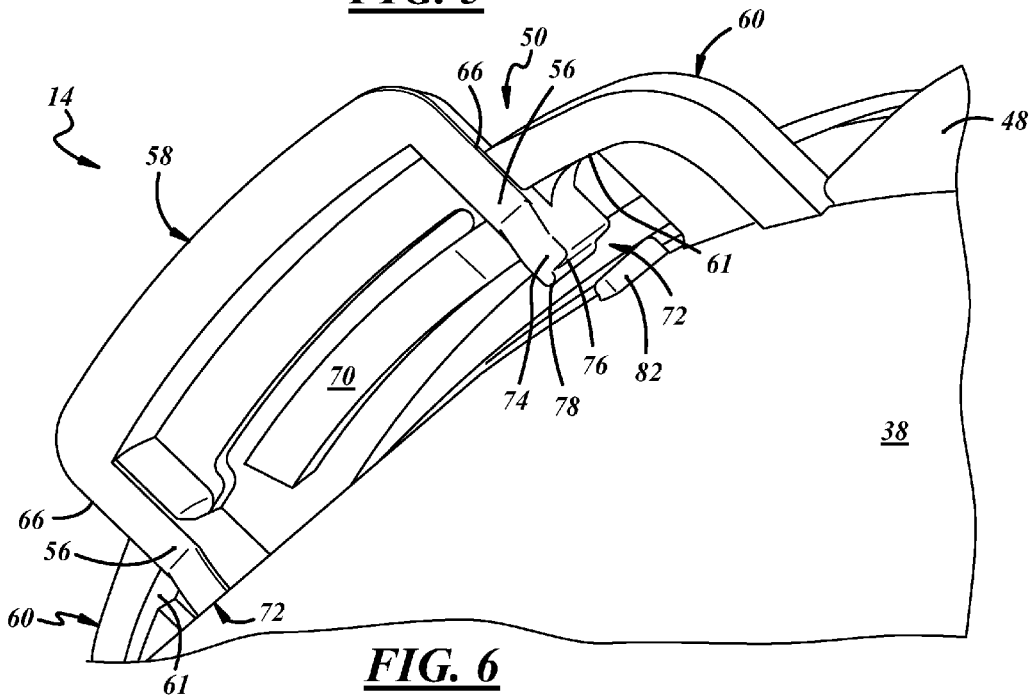
FIG. 6 is yet another enlarged fragmented perspective view of a portion of the container shown in FIG. 2.

Referring to FIGS. 5 and 6, the release 50 also includes stop means or deflection limiting elements. More specifically, the release 50 carries deflection limiting lugs 72. For example, the lugs 72 extend transversely inwardly toward the outer surface of the sidewall 38 from the transversely extending portions 66 of the finger tab 58, and extend inwardly with respect to inward surfaces 61 of the arms 60. Also, the lugs 72 include lower portions 74 that extend below the underside 56 of the finger tab 58. For example, the lugs 72 may extend less than about one millimeter below the underside of finger tab 58. The lugs 72 include inside edges or transversely inboard surfaces 76 that have ribs 78 that generally axially extend along, and generally transversely inwardly extend from, the inboard surfaces 76. The lugs 72 are normally spaced from the outer surface of the sidewall 38 such that deflection of the release 50 brings the lugs 72 into abutment with associated portions of the outer surface of the sidewall 38.

The lugs 72 are relatively low profile elements that do not hang down directly from the underside of the finger tab 58 along the sidewall 38. Rather, the lugs 72 primarily extend transversely inwardly toward the sidewall 38. Thus, such a low profile tends to reduce occurrences of hooking, shingling, or tangling of the container during material handling.

As shown in FIG. 5, a fixed end of the CR lug 70 is integral with a portion of one of the limiting lugs 72. This tends to provide increased support and rigidity to the CR lug 70 so as to improve resistance to forced removal of the closure 12 off of the package 10 (FIG. 1). In other words, integrating the fixed end of the CR lug 70 to the lug 72 tends to improve strip over torque required to forcibly remove the closure 12 from the container 14.

Referring to FIGS. 4 and 5, in addition to the deflection limiting features of the release 50, the sidewall 38 also include deflection limiting features. For example, the sidewall deflection limiting features include first stop edges 80. The stop edges 80 extend in a generally axial direction, and are defined by stops or beads 82 that extend axially along and project from the outer surface of the sidewall 38. By way of example only, the beads 82 extend outwardly about 0.005" to 0.050" from the outer surface of the sidewall. Between the edges 80, the container 14 includes a reinforcement pad 84 having a wall thickness greater than that of the wall thickness of the container sidewall 38 in other areas. For example, the wall thickness of the reinforcement pad 84 is 0.005" to 0.100" greater. The sidewall deflection limiting features also include second stops or stop edges 86. The stop edges 86 extend in a generally lateral or circumferential direction, and are defined by the reinforcement pad 84 or an increased wall thickness of the sidewall 38 or in any other suitable manner.

The beads 82 and the reinforcement pad 84 are of such relatively thin wall thickness to help reduce occurrences of hooking, shingling, or tangling of the container during material handling, and to allow container labels to be applied over the beads 82 with little to no wrinkling of the labels.

Referring to FIG. 4, when the release 50 of the container 14 is at rest, the upperside 52 of the release 50 is at about a 90 degree angle with respect to the axis A. Also, at rest, the lugs 72 are generally parallel with one another and the inward surfaces 76 of the lugs 72 are generally parallel with the axis A. Further, at rest, the lower ends 74 of the lugs 72 are transversely spaced from the stop edges 86 and spaced laterally inboard of the stop edges 86.

But when the release 50 is deflected downwardly upon application of a user's finger, the angle of the upperside 52 of the release 50 relative to the axis A increases, and the CR lug 70 is carried downwardly and moved out of engagement with the lock lug 28 on the closure 12 (FIG. 1) to allow the closure 12 to be rotated and removed from the container 14. Also, the angle of the inward surfaces 76 of the lugs 72 relative to the axis A decreases while the formerly parallel lugs 72 begin to diverge at an obtuse angle with respect to one another.

Upon continued downward deflection of the release 50, the lugs 72 eventually contact the sidewall 38 of the container 14 to at least somewhat limit deflection of the release 50, and this tends to avoid inelastic deformation, fatigue, or the like of the release 50. For example, the lugs 72 engage the sidewall 38, and spread further apart while sliding across the sidewall 38 until making contact with the first stop edges 80. More specifically, the ribs 78 on the lugs 72 engage the first stop edges 80 on the container sidewall 38. For instance, the ribs 78 include laterally outwardly facing surfaces for engagement with the beads 82. Such engagement prohibits further spreading of the lugs 72 and results in distribution of forces applied to the release 50 in a radial and/or perpendicular direction with respect to the container sidewall 38. In one embodiment, portions of the lugs 72 abut associated points of contact on the side wall 38.

Further depression of the release 50 causes the lugs 72 to generally slide along the stop edges 80 until the lugs 72 contact the second stop edges 86. Such additional engagement results in further distribution of forces applied to the release 50 in a generally axial direction with respect to the container sidewall 38.

Still further depression of the release 50 results in resilient deformation of the container sidewall 38 and some resilient deformation of the release 50. The aforementioned exemplary arrangement results in progressive distribution of forces applied to the release 50 and, thus, no individual portion of the release 50 or container sidewall 38 is stressed beyond its yield point.

There thus has been disclosed a child-resistant container that may satisfy one or more of the objects and aims previously set forth. The disclosure has been presented in conjunction with several exemplary embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A container for a child-resistant package, said container including:

a plastic container body having an outer wall surface, at least one external thread segment, a deflectable release element cantilevered from said outer wall surface beneath said thread segment and deflectable in an arc downwardly and inwardly toward said outer wall surface, and stop means between said deflectable release element and said outer wall surface to limit deflection of said release element, said stop means including:

laterally spaced lugs on an underside of said deflectable release element, said lugs extending toward said outer wall surface and having inside edges normally spaced from said outer wall surface such that deflection of said release element brings said inside edges of said lugs into abutment with associated laterally spaced points of contact on said outer wall surface, and a first pair of stops on said outer wall surface respectively positioned laterally outwardly of said points of contact such that further deflection of said release element after contact of said inside edges with said outer wall surface spreads said lugs laterally outwardly until said inside edges abut said first pair of stops.

2. The container set forth in claim 1 wherein said inside edges of said lugs include axial ribs with laterally outwardly facing surfaces for engagement with said first pair of stops.

3. The container set forth in claim 2 wherein said stop means further includes: a second pair of stops on said outer wall surface respectively axially adjacent to said first pair of stops, such that further depression of said release element after contact of said ribs with said first pair of stops moves said ribs into contact with said second stops, whereupon said inside edges of said lugs are trapped between said first and second stops.

4. A plastic container for a child-resistant package, said container including:

a sidewall with an outer surface, at least one external thread, a deflectable release cantilevered from said outer surface beneath said thread and deflectable axially downwardly and radially inwardly toward said outer surface, and deflection limiting elements carried by said deflectable release and said sidewall outer surface to limit deflection of said release, said deflection limiting elements including:

laterally spaced lugs transversely extending toward said sidewall outer surface from said deflectable release and having portions normally spaced from said sidewall outer surface, such that deflection of said release brings said portions of said lugs into abutment with said sidewall outer surface, and stop edges on said sidewall outer surface respectively positioned laterally outwardly of said laterally spaced lugs, such that further deflection of said release after contact of said lug portions with said sidewall outer surface spreads said lugs laterally outwardly until said inside edges abut said stop edges.

5. The container set forth in claim 4 wherein said lug portions include ribs for engagement with said stop edges.

6. The container set forth in claim 5 wherein said deflection limiting elements further include: second stop edges on said sidewall outer surface adjacent to said first stop edges, such that further depression of said release after contact of said ribs with said first stop edges moves said ribs into contact with said second stop edges, whereupon said lugs are trapped by said first and second stop edges.

7. The container set forth in claim 4 wherein said lug portions extend below an underside of said release.

8. The container set forth in claim 4 wherein said release includes a finger tab spaced from and coupled to said sidewall by laterally spaced arms, and said lug portions extend below an underside of said finger tab.

9. The container set forth in claim 8 wherein said arms include transversely extending portions coupled to said sidewall and laterally extending portions coupled between said transversely extending portions of said arms and said finger tab, said finger tab includes transversely extending portions coupled to said laterally extending portions of said arms and a laterally extending portion therebetween, and said lugs extend inwardly toward said sidewall from said transversely extending portions of said finger tab.

10. A plastic container for a child-resistant package, said container including:

a sidewall with an outer surface, a deflectable release cantilevered from said outer surface and deflectable toward said outer surface, and deflection limiting elements carried by said deflectable release to limit deflection of said release, said deflection limiting elements including:

laterally spaced lugs transversely extending toward said sidewall outer surface from said deflectable release and having portions normally spaced from said sidewall outer surface, such that deflection of said release brings said portions of said lugs into abutment with said sidewall outer surface, said deflection limiting elements also being carried by said sidewall and further including stop edges on said outer surface respectively positioned laterally outwardly of said laterally spaced lugs, such that further deflection of said release after contact of said lug portions with said sidewall outer surface spreads said lugs laterally outwardly until said inside edges abut said stop edges.

11. The container set forth in claim 10 wherein said lug portions include ribs for engagement with said stop edges.

12. The container set forth in claim 11 wherein said deflection limiting elements further include: second stop edges on said sidewall outer surface adjacent to said first stop edges, such that further depression of said release after contact of said ribs with said first stop edges moves said ribs into contact with said second stop edges, whereupon said lugs are trapped by said first and second stop edges.

13. The container set forth in claim 10 wherein said lug portions extend below an underside of said release.

14. The container set forth in claim 10 wherein said release includes a finger tab spaced from and coupled to said sidewall by laterally spaced arms, and said lug portions extend below an underside of said finger tab.

15. The container set forth in claim 14 wherein said arms include transversely extending portions coupled to said sidewall and laterally extending portions coupled between said transversely extending portions of said arms and said finger tab, said finger tab includes transversely extending portions coupled to said laterally extending portions of said arms and a laterally extending portion therebetween, and said lugs extend inwardly toward said sidewall from said transversely extending portions of said finger tab.

* * * * *